US010010240B2

(12) United States Patent
Cottone

(10) Patent No.: US 10,010,240 B2
(45) Date of Patent: Jul. 3, 2018

(54) PULSED LIGHT TREATMENT SYSTEM FOR SANITIZING FOOTWEAR

(71) Applicant: Cougar Packaging Concepts, Inc., St. Charles, IL (US)

(72) Inventor: Mark A. Cottone, St. Charles, IL (US)

( * ) Notice: Subject to any disclaimer, the term of this patent is extended or adjusted under 35 U.S.C. 154(b) by 0 days.

(21) Appl. No.: 15/198,455

(22) Filed: Jun. 30, 2016

(65) Prior Publication Data

US 2017/0000915 A1 Jan. 5, 2017

Related U.S. Application Data

(60) Provisional application No. 62/187,369, filed on Jul. 1, 2015.

(51) Int. Cl.

| | |
|---|---|
| ***A61L 2/10*** | (2006.01) |
| ***A47L 23/02*** | (2006.01) |
| ***A47L 23/26*** | (2006.01) |
| ***B08B 1/00*** | (2006.01) |

(52) U.S. Cl.

CPC ..... *A47L 23/02* (2013.01)

(58) Field of Classification Search

CPC ..... A61L 2/00; A61L 2/0029; A61L 2/0047; A61L 2/02; A61L 2/08; A61L 2/10; A61L 2202/00; A61L 2202/10; A61L 2202/11

USPC ..... 422/22, 24; 250/453.11, 454.11, 493.1, 250/504 R, 504 H

See application file for complete search history.

(56) References Cited

U.S. PATENT DOCUMENTS

2014/0305470 A1* 10/2014 Desu-Kalyanam ... A47L 23/263 134/6

* cited by examiner

*Primary Examiner* — Nicole Ippolito

(57) ABSTRACT

A system for sanitizing footwear through the use of pulsed ultraviolet (UV) light. The system can include an area that receives footwear of a user and applies a PUV light to the footwear to eliminate pathogens residing on the footwear. The system may contain a protective housing to ensure that exposure to the PUV light is limited to the footwear received in the PUV light area. The system contains electrical circuitry or control mechanism for operation of the PUV light. The system may also contain a brush area so that a user may remove dirt or solid particles from the footwear by engaging bristles that contact the underside and sides of the footwear. The intensity and the duration of the PUV light may be predetermined depending on the requirements of the facility intending to use the system.

11 Claims, 2 Drawing Sheets

PULSED LIGHT TREATMENT SYSTEM FOR SANITIZING FOOTWEAR

FIELD

The present disclosure generally relates to sanitizing footwear, and more particularly relates to a system incorporating a sanitization of footwear using pulsed ultraviolet (PUV) light.

BACKGROUND

Many facilities require individuals entering into those areas to have properly sanitized footwear prior to entry. This may include, for example, manufacturing plants, laboratory clean rooms, hospitals, surgical rooms, and other locations where it is of upmost importance that pathogens have been eliminated from footwear to prevent spread of disease, virus, or infection within the area.

Current methods for sanitizing footwear include both wet and dry methods. Wet methods include the use of water, detergent, alcohol, and/or other sanitizing chemicals. Wet methods suffer from the disadvantage that footwear that has not been properly dried after sanitization may present a safety hazard due to wet floors. Current dry methods include using ultraviolet ("UV") light, for example UV-C light. The UV light, when applied properly, is capable of reducing, if not substantially neutralizing, certain pathogens and other deleterious materials and substances that may be on the outside of the footwear. While current dry methods and systems use UV light, the level of intensity of the UV light and the manner in which it is applied may make the sanitization process time consuming and inefficient for eliminating pathogens on footwear. Pulsed ultraviolet ("PUV") light has the ability to inactivate pathogens at a DNA level.

SUMMARY OF THE DISCLOSURE

Disclosed is a system for sanitizing shoes using a PUV light. PUV light is UV light that is pulsed in part to increase the effective amount of energy applied at one time, yet reducing the dwell time of the UV light. PUV light is generally applied from a high intensity light source. The invention disclosed herein may use PUV as a sanitizing agent for the application of a broad band wave light in the range of 200-1100 nm. This light may be capable of a reduction in pathogens.

In an exemplary embodiment of the sanitization system, a user enters an area that uses PUV light to eliminate pathogens from the footwear. For example, the user may slide his foot and footwear into a slit that will close around the ankle creating a seal preventing the PUV light from escaping once it is activated. Preventing the PUV light from escaping is desirable as the light may have harmful effects to exposed parts of the user, such as the eyes. One manner in which the PUV light may be applied is a button that when pushed may commence an automated timed cycle that may be predetermined based on the pathogen reduction desired. The pathogen reduction may be determined based on the requirements of the particular facility using the system. The automated timed cycle may be electronically programmable, and may be remotely programmable through any wired or wireless connection. In an exemplary embodiment, the PUV light may run and may comprise multiple PUV lights that remain stationary or one PUV light that may move on a tracking system to cover the entirety of the footwear.

In another exemplary embodiment, prior to the application of PUV light to the footwear, a user may enter a brush area that may be a manual brushing of the footwear to remove dirt or other substances on the footwear. One way to achieve this is that the person may drag their feet through the brush area which may consist of stiff brush material or bristles applied to the sides and bottom of the footwear. Alternatively, the brush area can be an electrically powered system that would move the brushes or bristles to remove debris from the footwear.

In an exemplary embodiment, the system may comprise quartz glass platform that the user stands on which may allow 100% pass through of the PUV light. As an example, pulsed light UV area may be a box-like structure that the user steps into to allow for coverage of up to 3 inches up the sides of the user's footwear. As another example, the box-like structure may also contain reflective stainless or mirrored side panels that will reflect the PUV light for more efficient exposure. In an exemplary embodiment, the system may automatically shut off after a predetermined amount of time passes.

These and other aspects, advantages, applications and features of the disclosure will be better understood upon consideration of the following detailed description.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF AN EMBODIMENT

Figure 1:
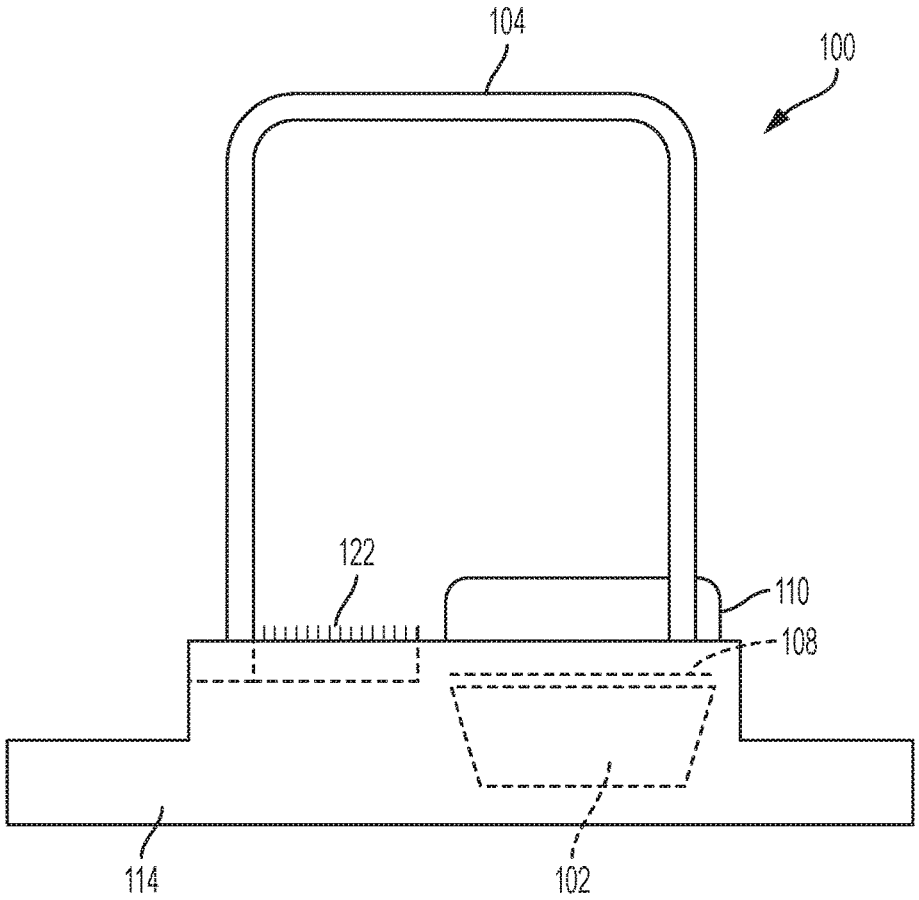
FIG. 1 is a side view of one embodiment of a system for sanitizing footwear.

FIG. 1 depicts a side view of an embodiment of a PUV light system 100 for sanitizing footwear. The system 100 may include a PUV light area 102, guide rails 104 and 106, quartz glass 108, a protective housing 110, a brush area 112, and a support structure 114.

Figure 2:
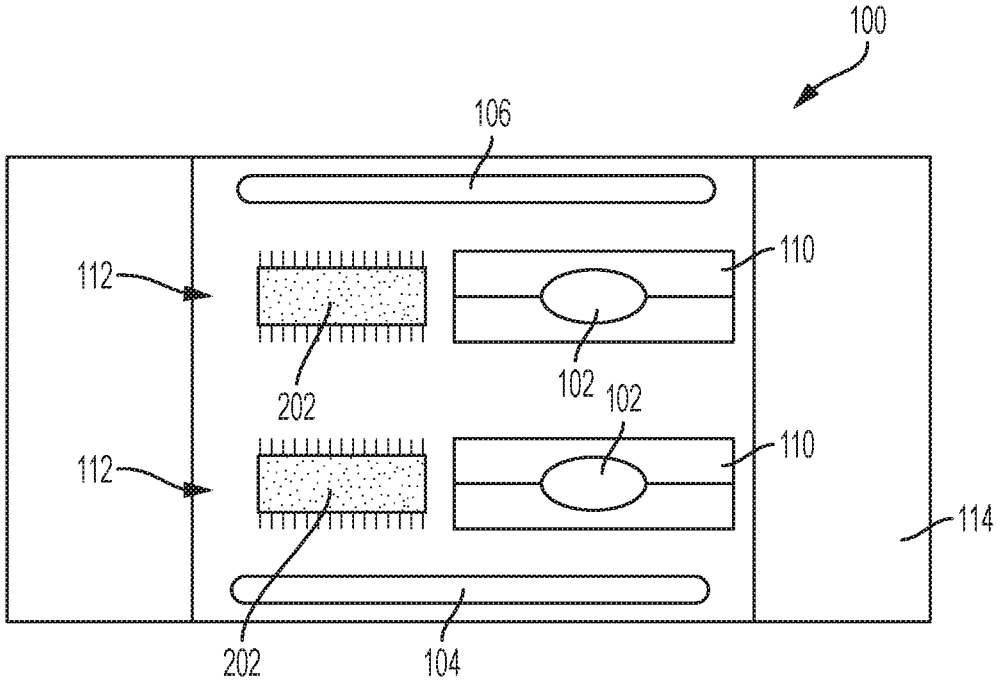
FIG. 2 is a top view of the embodiment of FIG. 1.

FIG. 2 depicts a top view of the embodiment shown in FIG. 1. The system 100 is described below with reference to both FIGS. 1 and 2.

In the system 100, a user may first step into brush area 112. The brush area 112 may contain bristles 202 (shown in greater detail in FIG. 2) that aid a user in removing dirt or other substances from the footwear. This may be achieved manually, by the user rubbing or dragging the footwear against the bristles 202, or via an automated manner that can be commenced electronically by the user. For example, a user can enter brush area 112 and push a button that triggers the bristles 202 to move against the user's footwear. As a further example, the bristles 202 may be configured to automatically move upon sensing that the user has entered brush area 112. The electrical and mechanical circuitry and components for achieving the automated movement of the bristles 202 may be housed in support structure 114, which is described in further detail below.

In system 100, a user may first enter the brush area 112 and then proceed to the PUV light area 102. The PUV light area 102 may contain a light source or element that supplies PUV light when activated by the system 100. In some embodiments, the system 100 may exclude the brush area 112 and contain a PUV light area 102 with the other elements. In that embodiment, the user proceeds to the PUV light area 102 and steps through the protective housing 110 into a depression or box-like structure so that the footwear is housed by a protective housing 110. This may be achieved by the protective housing 110 containing slits for the user to step into so that the user can stand in PUV light area 102.

Once a user stands in the PUV light area 102, the system 100 may be activated and the light source or element in PUV light area may be turned on to supply PUV light to the footwear residing in the PUV light area 102. This may be achieved by the user pressing a button causing the activation or system 100 to automatically activate when sensors receive a signal that the user is standing in the PUV light area 102. For an amount of time, PUV light is applied to the footwear in the PUV light area 102. The amount of time may be predetermined depending on a desired pathogen reduction level or requirements of the facility using the system 100. In an exemplary embodiment, the PUV light may run for up to 1 minute and may comprise multiple PUV lights that remain stationary or one PUV light that may move on a tracking system to cover the entirety of the footwear. For example, the system may sense the existence of the footwear and direct PUV light in areas where the footwear is detected.

The PUV light may be a broad band wave light in the 200-1100 nm range. The protective housing 110 can prevent the PUV light from escaping and limit the light exposure to the footwear without allowing the PUV light to expose other areas of the user that would cause damage, such as the user's eyes.

In an exemplary embodiment, the user may stand on a platform of the quartz glass 108 and the PUV light may be directed upwards through the quartz glass 108 and onto the footwear in the PUV light area 102. In an exemplary embodiment, the PUV light area 102 may be a box-like structure where the user steps down onto the PUV light area and the area extends approximately 3 inches up the sides of the footwear. This vertical distance is of course exemplary, and can vary depending on light intensity, shoe size and the like, as will be apparent to those implementing the invention. The platform or box could also be constructed of other materials, and not necessarily fully transparent. Thus, the platform could take the form of a grid or parallel bars made of rigid material, such as expanded metal, rigid plastic and other open-area or foraminous constructs which will support the user, but still allow sufficient light through. Further, in an exemplary embodiment, there may be reflective stainless or mirror panels along the sides of the box-like structure reflect the PUV light for a more effective exposure of the entirety of the footwear including the bottom, sides and top of the footwear.

The system 100 may also include guide rails 104 and 106 that can be gripped by the user for added stability while using the system 100. Guide rails may also contain components, such a control panel or buttons, that the user can engage in order to commence or stop activation of the PUV light or movement of the bristles 202. The electrical circuitry or control mechanism that controls the operation of system 100 may reside in support structure 114.

The present disclosure is thus considered to yield a PUV light sanitization system for sanitizing footwear by exposing it to PUV light sources, in one exemplary application of the disclosure. While this system has been described with respect to a particular embodiment(s), and application in a specific environment, those of skill will recognize modifications of components, elements, materials, arrangements, and the like which will still fall within the spirit and scope of the invention, and the invention is not to be limited to such embodiment(s) or specific details.

What is claimed is:

1. A system for sanitizing footwear, comprising:

a pulsed ultraviolet (UV) light area, having a light source to supply pulsed UV light, and configured to receive the footwear;

a control mechanism, in communication with the light source, that activates and deactivates the pulsed UV light; and protective housing that houses the footwear and contains the pulsed UV light within the pulsed UV light area when the pulsed UV light is activated; wherein the pulsed UV light is delivered across a range between 200-1100 nm and pulsed at a constant energy per pulse.

2. The system of claim 1, wherein the control mechanism deactivates the light source after the light source has been activated for a predetermined period of time.

3. The system of claim 1, further comprising a brush area that removes substances from the footwear.

4. The system of claim 3, wherein the brush area includes bristles that interact with the footwear to remove the substances.

5. The system of claim 1, wherein the pulsed UV light area contains a platform of quartz glass and the light source is positioned in a manner to shine the pulsed UV light through the quartz glass to the footwear.

6. The system of claim 5, wherein the pulsed UV light area is a box-like structure having the platform of quartz glass positioned on the bottom and the sides of the box-like structure comprising stainless or mirrored panels.

7. The system of claim 1, wherein the control mechanism moves the pulsed UV light on a tracking system.

8. The system of claim 1, wherein the light source includes two pulsed UV light sources that direct pulsed UV light towards the footwear.

9. The system of claim 1, wherein the protective housing includes slits that receive the footwear.

10. The system of claim 1, wherein control mechanism includes a control to allow the modification of the intensity or the duration of application of the UV light.

11. A system for sanitizing footwear, comprising:

a pulsed ultraviolet (UV) light area, having a light source to supply pulsed UV light, and configured to receive the footwear;

a control mechanism, in communication with the light source, that activates and deactivates the pulsed UV light;

and a protective housing that houses the footwear and contains the pulsed UV light within the pulsed UV light area when the pulsed UV light is activated, the housing contains a platform of quartz glass upon which a person stands and includes laterally opposed sidewalls for the housing presenting handrails on each side for a person to use for support in operation of the system, the light source is positioned in a manner to shine the pulsed UV light through the quartz glass to the footwear; and wherein the pulsed UV light is in a range between 200-1100 nm.

* * * * *